United States Patent [19]

Swan et al.

[11] Patent Number: 4,485,702

[45] Date of Patent: Dec. 4, 1984

[54] POSITIVE ACTION BASIN WRENCH

[75] Inventors: William C. Swan, 5940 Lindley Ave., Encino, Calif. 91316; Howard Kastan, 3085 Twin Oaks Rd., Cameron Park, Calif. 95682

[73] Assignees: William C. Swan, Encino; Howard Kastan, Cameron Park; Richard Magee, Sherman Oaks; Frank L. Zugelter, North Hollywood, all of Calif. ; a part interest

[21] Appl. No.: 504,856

[22] Filed: Jun. 20, 1983

Related U.S. Application Data

[63] Continuation of Ser. No. 240,013, Mar. 3, 1981, abandoned.

[51] Int. Cl.[3] ..... B25B 13/28

[52] U.S. Cl. ..... 81/98; 81/177 A

[58] Field of Search ..... 81/98, 111, 177 A, 53.1, 81/128, 177 D; 145/61 L, 65

[56] References Cited

U.S. PATENT DOCUMENTS

| | | | |
|---|---|---|---|
| 341,815 | 5/1886 | Newton . | |
| 614,255 | 11/1898 | McChesney | 81/98 |
| 1,385,180 | 7/1921 | Lizak | 81/DIG. 6 |
| 1,392,443 | 10/1921 | Petersen | 81/111 |
| 1,408,958 | 3/1922 | Phipps et al. | 81/DIG. 6 |
| 1,521,464 | 12/1924 | Miller . | |
| 1,795,048 | 3/1931 | Schuh | 81/98 |
| 2,018,154 | 10/1935 | Scott . | |
| 2,491,623 | 12/1949 | Sesak | 81/99 |
| 2,623,428 | 12/1952 | Larson | 81/99 |
| 2,869,410 | 1/1959 | Prichard | 81/177 A |
| 2,875,659 | 3/1959 | Haberle | 81/99 |
| 2,953,050 | 9/1960 | Nolen | 81/99 |
| 4,276,791 | 7/1981 | Thompson | 81/111 |

FOREIGN PATENT DOCUMENTS

| | | | |
|---|---|---|---|
| 2248119 | 5/1975 | France | 81/98 |

*Primary Examiner*—James G. Smith

*Attorney, Agent, or Firm*—Frank L. Zugelter

[57] ABSTRACT

A positive action basin wrench comprising a torsion bar spring mounted in a hollow shaft of the wrench and which is actuated to produce a pre-load grip on a work element (nut) held between a pair of jaws, one being movable. A tubular member in the shaft drives the torsion bar spring the action on which causes a pinion/gear arrangement at the head end of the shaft to turn a post rotatably mounted in a transverse extension to the shaft, the movable jaw in turn rotated as the post is rotated and being mounted atop the extension. The driving member for the spring rotates in the shaft to the extent of a pair of opposing aligned slots therein, by means of a crossbar projecting through such member and out of the slots in the shaft. As the crossbar is rotated, the tubular member and spring turn before the shaft does, causing the movable jaw to grip with the fixed jaw the nut, while reaction in the spring twists it until the crossbar is stopped by the slots' ends. The shaft of handle now rotates in conventional manner, however, the movable jaw does not slip off the nut and a common (single) driver for the wrench is maintained. There is no need for a second hand of the operator to replace the otherwise slipped-off movable jaw.

16 Claims, 6 Drawing Figures

FIG. 3
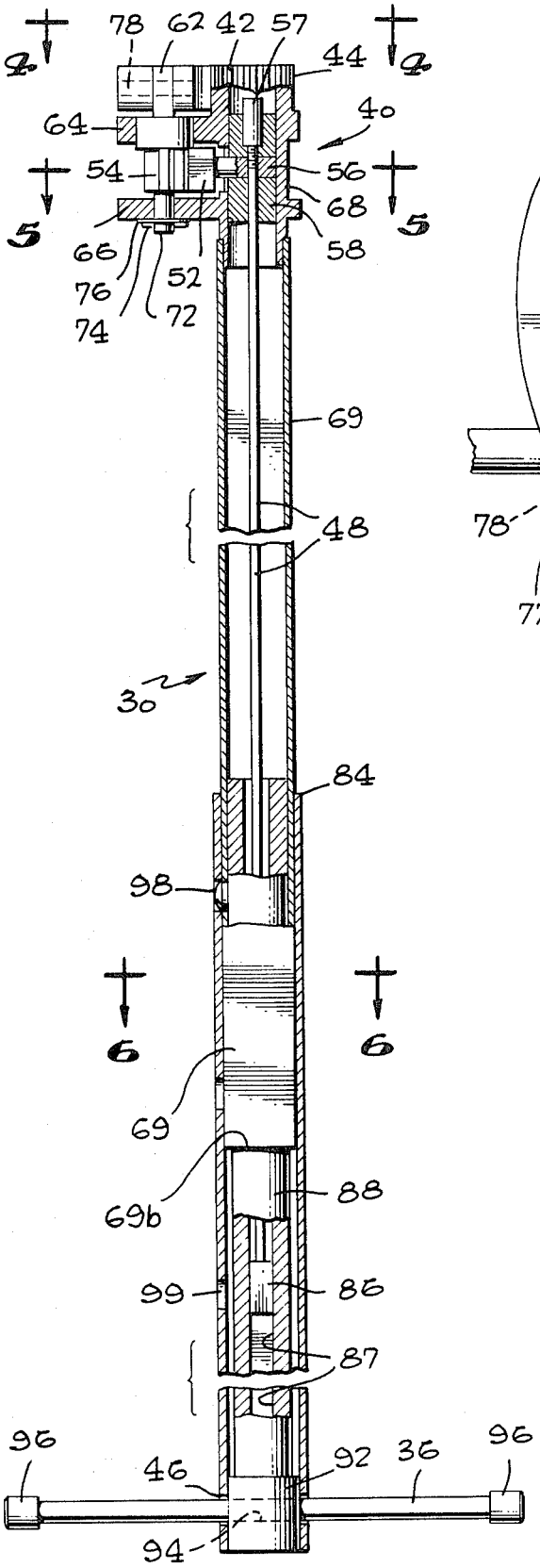
FIG. 4
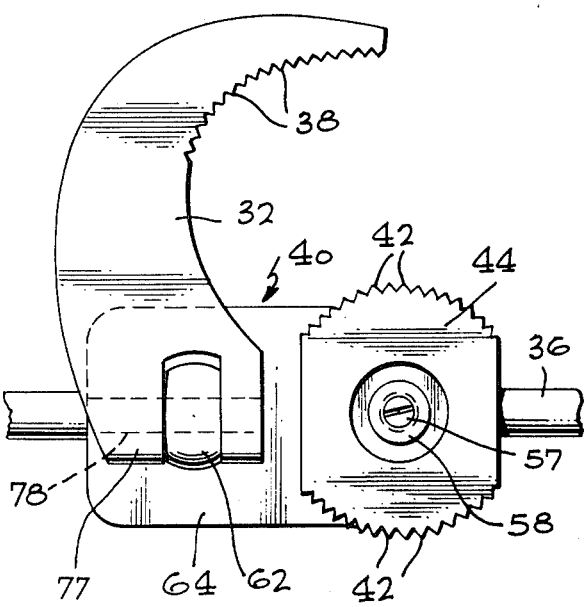
FIG. 5
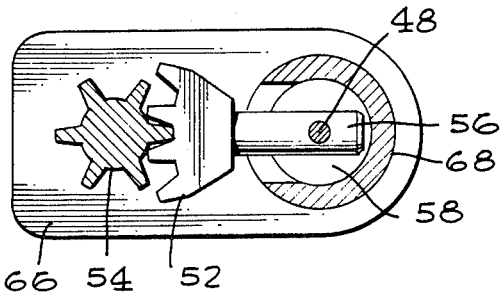
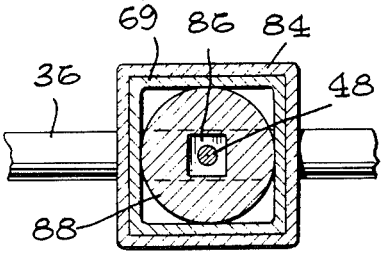
FIG. 6

POSITIVE ACTION BASIN WRENCH

This application is a continuation application of Ser. No. 240,013, filed Mar. 3, 1981 now abandoned.

TECHNICAL FIELD

The invention relates generally to the field of wrenches, and more particularly to the field of basin wrenches adapted for use in confined and hard-to-work in areas.

BACKGROUND AND BACKGROUND ART

Frequently, in the installation and removal of faucets and spouts in washbasins or lavatories, a plumber must operate in confined and difficult-to-work in spaces. While operating in such confined areas, engagement and disengagement of present technology wrench jaws with basin and lavatory mounting nuts must usually be done by the operator reaching up from below with one hand, while holding the bottom or handle end of the wrench with the other hand. The installation or removal operation is thus often awkward, tiring, and slow.

One common and readily recognized type of nut and pipe wrench is depicted in U.S. Pat. Nos. 1,385,180 to Lizak, and 1,408,958 to Phipps et al. Both patents show wrenches adapted to grip polygonal or curved surfaces, and include jaws adapted to slip about the corners of a nut or about the surface of a pipe when the wrench handle is swinging in one direction, and will securely grip the nut or pipe, when the wrench handle is swinging in the opposite direction. The wrenches are provided with manually operated adjustor elements for increasing or decreasing the gap between opposing jaw elements.

Various embodiments of self-tightening pipe wrenches are shown in U.S. Pat. Nos. 341,815 to Newton, 2,623,428 to Larson, 2,875,659 to Haberle, and 2,953,050 to Nolen. As was the case with the aforementioned nut and pipe wrenches, the opposed jaw elements of these "self-tightening" pipe wrenches securely grip a nut or pipe when the wrench handle is swinging in a particular direction. However, the jaws are self closing, and must be opened by hand to be placed in surrounding-engaging relation with the nut or pipe being turned.

Several specialized basin-type wrenches are used in the plumbing trade in certain instances, such as to install or remove basin or lavatory faucets and spouts after the basin and lead-in plumbing are in place. The faucets and spouts must be attached to, or detached from, the basin itself and the pipes stubbed out from the wall below the basin. Since the sizes of the installation nuts and connectors are not typically uniform from one such job to another, the basin wrench must be capable of accepting a rather wide range of nut sizes. For this reason the wrenches include one fixed jaw and one movable jaw. Examples of three wrenches which utilize such fixed and movable jaw arrangements can be found in U. S. Pat. Nos. 1,521,464 to Miller, 2,018,154 to Scott, and 2,491,623 to Sesak. The wrenches in these patents include self-closing jaw elements which securely grip pipe or nut elements upon rotation in a particular direction of a wrench handle. Various embodiments of the jaw elements of these patents rotate about an axis separate and parallel to the wrench handle axis. Leverage and rotation of the jaws is applied via rotation of bar or handle elements having an axis transverse to the wrench handles.

All of the above prior art wrenches require difficult operator hand jaw manipulation and/or adjustment for engagement and disengagement of the wrench jaws with the mounting nut or pipes. In the case of washbasins or lavatory installation or removal, engagement and disengagement of the wrench jaws of the '464, '154, and '623 patents with the mounting nut most probably would have to be carried out by the operator reaching up from below with one hand, while holding and twisting the bottom or handle end of the wrenches with the other hand.

Another problem manifests itself in that the rotational motion of the wrench, required to tighten or loosen a nut, is often severely limited by the proximity of the basin bowl and the wall behind the basin. In such circumstances the wrench must be disengaged from the nut and backed-off frequently, re-engaged with the nut, and rotated again in the desired direction. It is desirable to achieve this "ratcheting" action without the need to reach up to the nut and jaws with one hand in order to secure the engagement or disengagement of wrench jaws and nut.

From the foregoing, it can be seen that it is a primary object of this invention to provide a positive action basin wrench that enables complete, positive control of the engagement and disengagement of the wrench jaws with the mounting nuts of basins and lavatories, and the like, from the handle end of the wrench.

It is also an object of this invention to provide a positive action basin wrench having high reliability of engagement of the wrench jaws with the nut to be turned.

A further object of this invention is to provide a basin wrench capable of carrying out a "ratcheting" action without the need for manually reaching up and handling the wrench jaws or an adjustor element located in proximity of the jaws.

DISCLOSURE OF INVENTION

The invention is a positive action basin wrench for engaging and turning nuts, pipes, and similar work elements. The wrench includes one toothed fixed jaw and one toothed movable jaw for gripping and engaging the work element. The movable jaw is activated and rotated by a gear mechanism that is operative via a torsion bar spring/drive mechanism that travels substantially from the gear mechanism to the opposite (operator) end of the wrench. Means such as a crossbar at the operator end of the wrench handle is operative with the drive mechanism such that upon initial, limited rotation of the crossbar, the movable jaw is caused to rotate and grip the work element. Continued rotation of the crossbar, in the same direction, tightens or loosens the work element as desired. Reversal of the direction of rotation of the crossbar causes the movable jaw to rotate in the opposite direction and release the work element. The movable jaw is pivotable relative to the axis of the wrench such that upon rotation of the crossbar the work element can be either tightened or loosened, as desired.

The novel features which are believed to be characteristic of the invention, both as to its organization and its method of operation, together with further objects and advantages thereof, will be better understood from the following description, taken in connection with the accompanying drawings in which a presently preferred embodiment of the invention is illustrated by way of example. It is to be expressly understood, however, that the drawings are for purposes of illustration and description only, and are not intended as a definition of the limits of the invention.

BRIEF DESCRIPTION OF DRAWINGS

FIG. 3 is a side elevation, partially broken away, of the positive action basin wrench of the present invention;

FIG. 4 is a cross-section to enlarged scale taken on line 4—4 of FIG. 3;

FIG. 5 is a cross-section to enlarged scale taken on line 5—5 of FIG. 3; and

FIG. 6 is a cross-section to enlarged scale taken on line 6—6 of FIG. 3. In the various drawing figures, like numerals denote like parts.

BEST MODE FOR CARRYING OUT THE INVENTION

Figure 1:
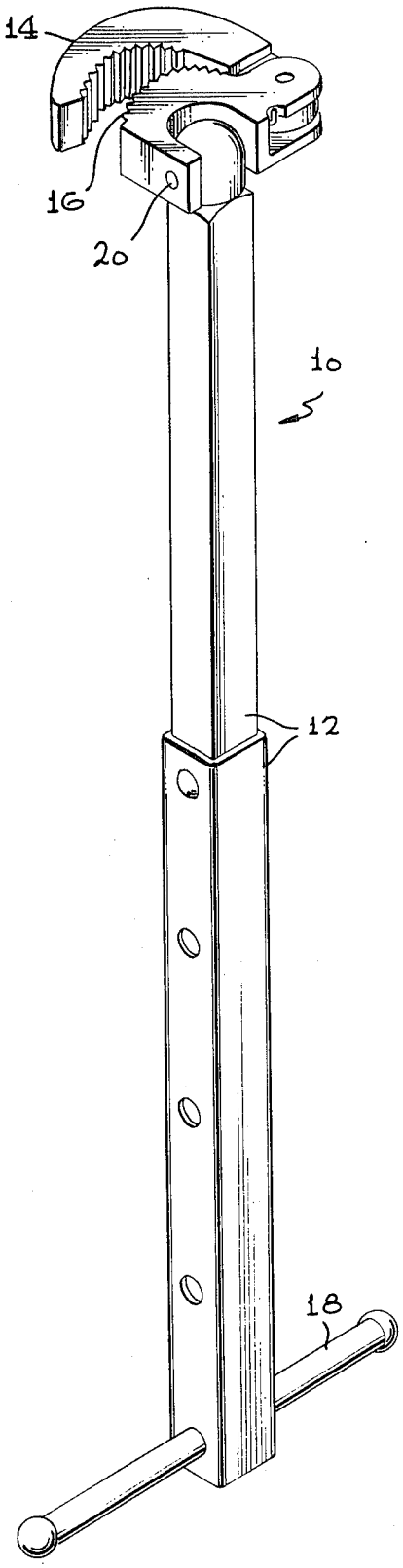
FIG. 1 PRIOR ART
FIG. 1 is a perspective view of a prior art basin wrench.

Referring to the details of the drawings, FIG. 1 shows a prior art basin wrench 10, including a telescoping handle 12 and a spring loaded movable jaw 14 for clamping a nut or pipe (not shown) against a gripping face 16. For initial engagement of the wrench 10 with the work element, the operator must reach up and hold the movable jaw 14 open, against its preload spring, so that the jaws may be positioned on opposite sides of the work element. Subsequently, for each disengagement and re-engagement (ratcheting), the operator usually must reach up again because the spring preload is insufficient for re-engagement and, often, the wrench slips off the work element entirely. The entire wrench 10 and the work element are rotated, after engagement by turning the cross bar 18. The movable jaw 14 and gripping face 16 may be rotated about the shaft 20 to tighten or loosen a nut.

As stated hereinabove, when a plumber is working in a confined space, this type of prior art wrench requires that each time the wrench jaws must be engaged or disengaged with the nut or pipe, the plumber must move or maintain a hand in contact with the movable jaw. This can be quite inefficient, tiring, and time consuming.

Figure 2:
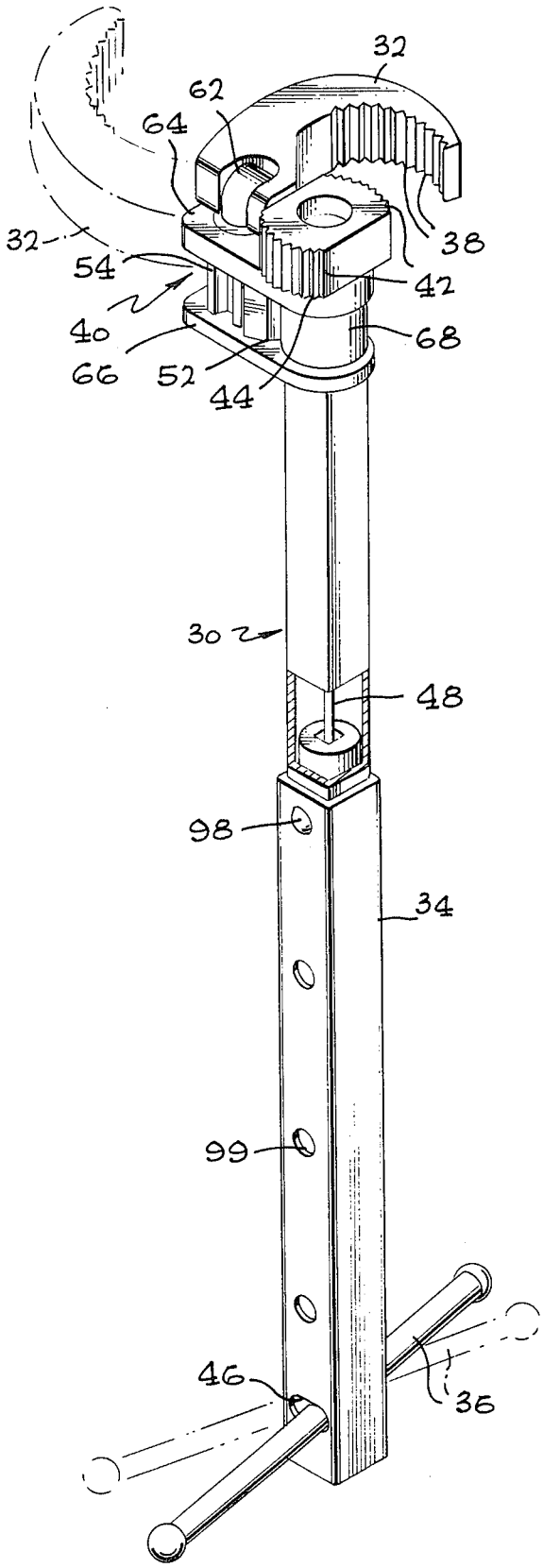
FIG. 2 is a perspective view of the positive action basin wrench of the present invention, an alternative adjusted position being shown in broken lines.

The positive action basin wrench 30 of the present invention, as shown in FIG. 2, obviates this problem by enabling an operator to completely activate and engage or disengage a movable jaw 32 on the upper end of the wrench shaft 34, via a crossbar 36 located at the lower end of the shaft.

Mounted to the shaft 34 is a head assembly 40, which includes the movable jaw 32, and other elements which will be described hereinafter. The movable jaw 32 is provided with teeth 38, which together with the teeth 42 on a fixed jaw 44, act to grip any nut or pipe about which the jaws 32 and 44 are placed.

The shaft 34 is hollow, and the crossbar 36 projects through two opposing aligned slots 46, their dimension being transverse to the axis of the shaft, and are of a length longer than the cross-sectional dimension for the crossbar, so as to provide free or independent but limited rotation of crossbar 36 before it engages and rotates the shaft. This limited motion of crossbar 36 drives a torsion bar spring 48 which in turn drives a gear arrangement including a gear segment 52 and a pinion 54. Together these elements drive movable jaw 32 about a or its pivot. Activation of this driving arrangement in one direction puts movable jaw 32 into a "full open" position, ready to be placed about a nut or pipe. Such directed activation is depicted in FIG. 2 in phantom. And by referring to FIG. 3, it becomes apparent that the movement of crossbar 36 into its phantom position in FIG. 2 causes a chain of action for the wrench's elements shown in FIG. 3 to produce the "full open" position shown in phantom in FIG. 2 for movable jaw 32.

Referring now to FIGS. 3 and 5, at the top of the torsion bar spring 48 is a gear segment 52, which rotates with the bar spring and drives a pinion (54). The gear segment 52 includes a shaft (56) which is secured to the torsion bar spring 48 by a set screw 57. The shaft 56 passes through a hole in an upper drive fitting 58 which is secured to the torsion bar spring 48. Thus when the torsion bar spring 48 is rotated, pinion 54 is caused to rotate.

As can be seen with reference to FIGS. 2 and 3, the movable jaw 32 is pivotally secured to a drive lug 62 and follows rotation of the gear-driven pinion. Drive lug 62 is secured to the pinion 54 which is rotatably mounted between a pair of spaced members 64, 66 mounted to or extending from a frame member 68. Frame members 68 is secured at the head end of wrench 30 by being rigidly attached to a drive member or tube 69 to which fixed jaw 44 and shaft 34 are suitably secured. A post 72 on drive lug 62, below pinion 54, is shown rotatably mounted in spaced member 66, and is held thereto by an arrangement of a cotter pin 74 and washer 76.

The movable jaw 32 includes a yoke 77 rotatably connected to jaw drive lug 62 via a pin 78, such rotation enabling it to be flipped over to the opposite side of the fixed jaw 44. This arrangement permits the wrench to be used for clockwise or counterclockwise (tightening or loosening) rotation of a nut without involving any disassembly and reassembly of the wrench, or the need for any supplementary, loose parts.

While the basin wrench 30 of the present invention is operable with a hollow shaft of fixed length, it is preferred to utilize the head assembly 40 in conjunction with a variable length shaft, such as the one depicted in FIGS. 2, 3 and 6. Such arrangement is briefly described in the description of the assembly for the wrench, which follows. However, it should be understood that such adjustable arrangement is state-of-the-art knowledge and does not go to the essence of the invention. Such an arrangement gives the wrench maximum utility for different applications and working areas. And it should be readily understood, too that the operational features of the wrench head and activation mechanism depicted in these figures are readily applicable to a non-telescoping wrench handle.

Referring now to FIGS. 2, 3 and 6, the shaft 34 is shown to include upper and lower square tube members 69 and 84, respectively. A rectangular bottom drive fitting 86 is fitted on the bottom end of torsion bar spring 48, which slidably fits in a rectangular passage 87 in a drive member or tube 88 for torsion bar spring 48. The outside diameter of the drive tube 88 is a sliding fit inside the upper square tube member 69. A short length large diameter or circular section 92 of the drive tube 88 is a sliding fit in the inside of the lower square tube member 84 and therefore, drive tube 88 can be rotated freely in tubes 69 and 84. The inside width of the lower square tube member 84 is a sliding fit on the outside of the upper square tube member 69. A portion of the torsion bar spring 48 and the fitting 86 itself extend below the bottom end 69*b* of square tube member 69.

In assembling the wrench, the torsion spring drive tube 88 is slipped into the upper square tube member 69, sliding up around the torsion bar spring 48. The rectangular passage 87 engages the bottom drive fitting 86 of the torsion bar spring. The lower square tube member 84 is then slipped over the larger diameter base section 92 and the outside of the upper square tube member 82. When the slots 46 in the lower square tube member 84 and a round hole or bore 94 in the torsion spring drive tube 88 are aligned, the crossbar 36 is installed through the aligned slots and hole, and end caps 96 are attached to the crossbar to secure and capture the assembly. A spring loaded detent button 98 (not shown) is installed in the upper square tube member 82. Detent button 98 selectively engages holes 99 drilled through one side of the lower square tube member 84 for establishing the length of the wrench 30, as desired.

Upper drive fitting 58 is positioned in frame member 68 so that shaft 56 of gear 52 can be inserted through frame member 68. Then the end of bar spring 48 can be passed through upper drive fitting 58 and gear shaft 56 as shown in FIG. 3, after which set screw 57 secures the bar spring 48 in position. The upper square tube member 69 may or may not be welded to frame member 68 at the time of assembling together elements 48, 58, 56 and 57, as the assembler desires. It is apparent that post 72 and pinion 54 are mounted to extension members 64, 66 after driving gear 52 is positioned relative to upper drive fitting 58. Movable jaw 32 is assembled, via pin 78, to drive lug 62 at any suitable time of assembly.

The operation of the positive action basin wrench of the present invention is as follows: If a nut is located between the fixed jaw 44 and the movable jaw (32), and the movable jaw 32 is rotated to contact the nut, any additional rotation of the crossbar 36 in the same, gripping, direction twists the torsion bar spring 48, thereby clamping the nut firmly between the jaws. Since the crossbar 36 is installed in limited length slots 46, continued rotation of the crossbar will drive the shaft 34 itself and, thus, rotate the nut. Reversal of the direction of motion of the crossbar 36 will disengage the movable jaw 32 from the nut and rotate the entire wrench back to its original position. This operation may be repeated, and the nut continued to be tightened (or loosened), as desired, by this "ratcheting" action of the wrench 30.

In accordance with the instant invention, engagement of the jaws 32 and 44 with the nut, preloading of the jaws on the nut, and opening of the jaws for disengagement, are all accomplished by operating the crossbar at the bottom of the wrench. It is not necessary then, with the wrench 30, to reach up or out with one hand to operate the movable jaw 32 directly, in order to engage, preload and disengage, or re-engage the nut if the wrench happens to slide off or slip, as frequently occurs in the environments where such wrenches are typically used. The entire wrench 30 is self-contained, positively engaged or disengaged, positively pre-loaded for self-energizing of the jaws, and positively driven for desired tightening or loosening of the nuts and connectors being worked upon. All of these essential functions are performed from the bottom of the wrench.

The novel positive action basin wrench 30 of the present invention then, offers the following distinct advantages over known prior art basin wrenches:

(1) Positive control of the movable jaw 32 from the bottom of the wrench 30 to facilitate operation of the wrench on a nut.

(2) Opening control of the jaw 32 to permit rotation of the wrench counter to the desired direction of rotation of a nut without inducing counter-rotation of the nut.

(3) Closing control of the jaw 32 on a nut to initiate preloading of the jaws on the nut.

(4) Greater preloading capability of the closed jaws on a nut than is available with other basin wrenches. This preloading is critical for triggering the self-energized clamping of the jaws on the nut for adequate gripping for the high wrench torques required to tighten nuts during installation, or to break loose nuts for removal. The higher preloading also reduces the possibility of injury to the operator caused by wrench slippage.

(5) Maintenance of preload of the closed jaws on a nut during rotation of the nut by the wrench so that, even if slippage of the wrench on the nut should occur, reengagement will occur.

It is apparent that there has been provided with this invention a novel positive action basin wrench which fully satisfies the objects, means and advantages set forth hereinbefore. While the invention has been described in combination with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

Industrial Applicability

The positive action basin wrench of the present invention is useful in the installation and removal of faucets and spouts in washbasins or lavatories, and in imparting rotation to work elements such as nuts, pipes, and the like.

We claim:

1. In a wrench of a class of wrenches having a pair of jaws in opposing relationship to each other, with both jaws being securely mounted at a head end for a shaft of the wrench and having a movable jaw pivotally mounted on a post rotatable in a frame member securely mounted at such head end for cooperation with a corresponding one of the pair of fixed jaws upon a work element, the improvement comprising:

a torsion bar spring having opposing ends and being disposed in a hollowness provided in the shaft, a first rotatable drive means operatively connected to one end of said bar spring and being mounted within, and independently rotatable from, the hollow shaft, a second rotatable drive means operatively connected to and at the other end of said bar spring and being mounted within, and independently rotatable from, the hollow shaft, means operatively connecting said first drive means in the hollow shaft to said post on the frame member, and means for rotating said second drive means extending across and projecting from the hollow shaft adjacent to the latter's non-head end, the hollow shaft including opposing aligned slots in which said rotating means is disposed and across which said rotating means moves before it engages the ends of said slots to rotate said shaft.

2. The improvement of claim 1 wherein the means operatively connecting the first drive means to said post comprises:

a pinion secured to the post and a gear element secured to the torsion bar spring and extending therefrom to mesh with the pinion.

3. The improvement of claim 2 wherein the rotating means for said second drive means comprises:

a crossbar mounted in said opposing aligned slots, the formation of each of such slots having a dimension transverse to the axis of the shaft longer than a dimension of an aperture for the shaft substantially equal to the cross-sectional dimension for the crossbar so that the rotation of the crossbar is free of rotation of the shaft to the extent of such transverse dimension.

4. The improvement of claim 1 wherein the rotating means comprises:

a cross bar mounted in said opposing aligned slots, the formation of each of such slots having a dimension transverse to the axis of the shaft longer than a dimension of an aperture for the shaft substantially equal to the cross-sectional dimension for the crossbar so that the rotation of the cross bar is free of rotation of the shaft to the extent of such transverse dimension.

5. In the improvement of claim 1, the frame member comprising:

a pair of spaced members transverse to the shaft and in which the post is rotatably mounted, the operatively connecting means being positioned between such spaced members.

6. In the improvement of claim 2, the frame member comprising:

a pair of spaced members transverse to the shaft and in which the post is rotatably mounted, the operatively connecting means being positioned between such spaced members.

7. In the improvement of claim 3, the frame member comprising:

a pair of spaced members transverse to the shaft and in which the post is rotatably mounted, the operatively connecting means being positioned between such spaced members.

8. In the improvement of claim 4, the frame member comprising:

a pair of spaced members transverse to the shaft and in which the post is rotatably mounted, the operatively connecting means being positioned between such spaced members.

9. A wrench apparatus comprising:

a hollow shaft having a head end and a non-head end, a frame member securely mounted at said head end, a pair of fixed jaws in opposing relation to one another securely mounted to said head end, a rotatable post mounted in said frame member and in general parallel alignment to said shaft, a movable jaw pivotally mounted to said post for cooperation with a corresponding one of the pair of fixed jaws, a torsion bar spring having opposing ends and being disposed in said hollow shaft, a first rotatable drive means operatively connected to one end of said bar spring and being mounted within, and independently rotatable from, the hollow shaft, a second rotatable drive means operatively connected to and at the other end of said bar spring and being mounted within, and independently rotatable from, the hollow shaft, means operatively connecting said first drive means in the hollow shaft to said post on the frame member, and means for rotating said second drive means extending across and projecting from the hollow shaft adjacent to the latter's non-head end, the hollow shaft including opposing aligned slots in which said rotating means is disposed and across which said rotating means moves before it engages the ends of said slot to rotate said shaft.

10. The apparatus of claim 9 wherein said means operatively connecting the first drive means to said post comprises:

a pinion secured to the post and a gear element secured to the torsion bar spring and extending therefrom to mesh with the pinion.

11. The apparatus of claim 10 wherein said rotating means comprises:

a crossbar mounted in said opposing aligned slots, the formation of each of such slots having a dimension transverse to the axis of the shaft longer than a dimension of aperture for the shaft substantially equal to the cross-sectional dimension for the crossbar so that the rotation of the crossbar is free of rotation of the shaft to the extent of such transverse dimension.

12. The apparatus of claim 9 wherein said rotating means comprises:

a crossbar mounted in said opposing aligned slots, the formation of each of such slots having a dimension transverse to the axis of the shaft longer than a dimension of aperture for the shaft substantially equal to the cross-sectional dimension for the crossbar so that the rotation of the crossbar is free of rotation of the shaft to the extent of such transverse dimension.

13. The apparatus of claim 9 wherein said frame member comprises:

a pair of spaced members transverse to the shaft and in which the post is rotatably mounted, the operatively connecting means being positioned between such spaced members.

14. The apparatus of claim 10 wherein said frame member comprises:

a pair of spaced members transverse to the shaft and in which the post is rotatably mounted, the operatively connecting means being positioned between such spaced members.

15. The apparatus of claim 11 wherein said frame member comprises:

a pair of spaced members transverse to the shaft and in which the post is rotatably mounted, the operatively connecting means being positioned between such spaced members.

16. The apparatus of claim 12 wherein said frame member comprises:

a pair of spaced members transverse to the shaft and in which the post is rotatably mounted, the operatively connecting means being positioned between such spaced members.

* * * * *